United States Patent [19]

Barrett

[11] 4,160,550

[45] Jul. 10, 1979

[54] GOLF PUTTING FRAME GAME DEVICE

[76] Inventor: Donald R. Barrett, Rte. 1, Box 116, Gable, S.C. 29051

[21] Appl. No.: 867,679

[22] Filed: Jan. 9, 1978

[51] Int. Cl.[2] ..... A63B 69/36; A63G 31/00

[52] U.S. Cl. ..... 273/176 F; 273/177 B; 273/14

[58] Field of Search ..... 273/8, 9, 14, 87 B, 273/87 C, 176 F, 176 FA, 176 E, 176 B, 176 FB, 177 B

[56] References Cited

U.S. PATENT DOCUMENTS

| | | | |
|---|---|---|---|
| 223,208 | 12/1879 | Disston | 273/14 |
| 1,150,517 | 8/1915 | Hawks | 273/176 F |
| 1,886,399 | 11/1932 | Hause | 273/176 F |
| 2,526,334 | 10/1950 | Cusano | 273/9 X |
| 2,827,299 | 3/1958 | Dean | 273/176 F |
| 3,138,387 | 6/1964 | Michel et al. | 273/8 X |
| 3,360,265 | 12/1967 | Yabroudy | 273/87 B |
| 3,591,176 | 7/1971 | Roth | 273/8 X |
| 3,877,702 | 4/1975 | Saliger | 273/9 X |

FOREIGN PATENT DOCUMENTS

| | | | |
|---|---|---|---|
| 23487 of | 1909 | United Kingdom | 273/14 |
| 358362 | 10/1931 | United Kingdom | 273/176 F |

*Primary Examiner*—George J. Marlo
*Attorney, Agent, or Firm*—Edwin B. Brading

[57] ABSTRACT

A golf putting frame game device is used on a flat surface to play golf putting games and features uniform rebounds of playing balls from the interior sides of the frame. The frame is provided with a capturing device in the form of a flexible cord which is stretched across a corner of the frame. Multiple supports are provided to anchor the ends of the cord at different locations which permit the size and shape of the capturing device to be varied. Uniform rebounds are provided by cushions on the interior walls of the frame. A multitude of games can be played utilizing rebound combinations with or without a capturing device attachment. The game device also includes a cushioned corner insert which may be positioned across a corner of the frame when it is desired to block any access to the capturing device in that corner.

1 Claim, 4 Drawing Figures

GOLF PUTTING FRAME GAME DEVICE

BACKGROUND OF THE INVENTION

1. Field of Invention

This invention relates generally to recreational game devices and, more particularly, to a golf putting frame device.

2. Description of Prior Art

There are known devices used for playing golf putting games both inside and outside enclosed areas. The primary purpose of these devices is to provide a target hole toward which a player exercises his skill in golf putting. Some of these devices are self-contained portable units and others are permanently constructed fixtures.

U.S. Pat. No. 3,861,524 discloses a portable sectional game board which, when unfolded and opened up, provides a target hole for golf putting practice and is a self-contained foldable portable unit. The side rails play no significant part in the game except as a support for the portable unit.

U.S. Pat. No. 3,138,387 discloses a miniature golf course which is constructed over a surface in which target holes already exist. However, the target holes themselves are not a part of the frame device and the side rails play no significant part in the playing of the game except to serve as exterior barriers.

SUMMARY OF THE INVENTION

According to this invention, there is provided a golf putting frame game device which is suitable for use on a flat surface and which has cushions on the interior side walls of the device enabling the playing of golf putting games featuring uniform ball rebounds.

This golf frame game device can contain on the frame itself a capturing device attached to the interior side walls of the frame. These capturing devices can be adjustable and removable to increase the difficulty of the game and to increase the emphasis of cushioned rebounds.

Although this golf frame game device can be utilized as a large permanently constructed fixture, it is preferrably used as a relatively small portable frame which can be easily dismantled for storage in a residential garage, storage room or closet. The frame wound then constitute a self-contained unit useable inside or outside an enclosed area without other props or permanent implacements.

DESCRIPTION OF PREFERRED EMBODIMENTS

Figure 1:
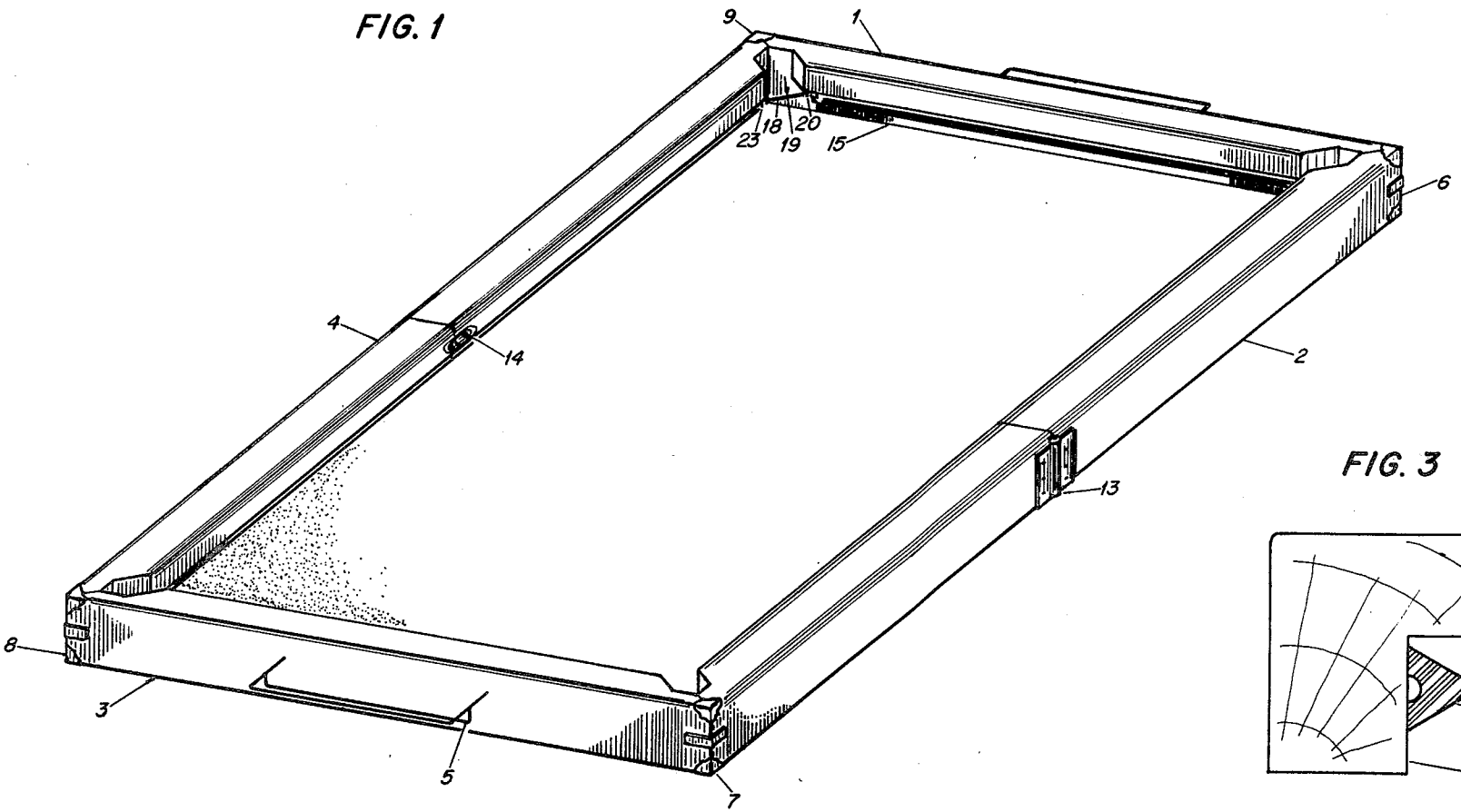
FIG. 1 is a plan view of the frame game device.

Referring to the drawing, FIG. 1 shows a rectangular frame device having sides 1, 2, 3 and 4. While each side may vary in size and shape, it is preferred for the sides to have such length as to provide a rectangular shaped frame and most preferred to have two approximately eight foot long sides and two approximately twelve foot long sides.

A ball storage rack 5 may be provided on the frame for storing balls not being used and may be designed to facilitate scorekeeping.

Figure 2:
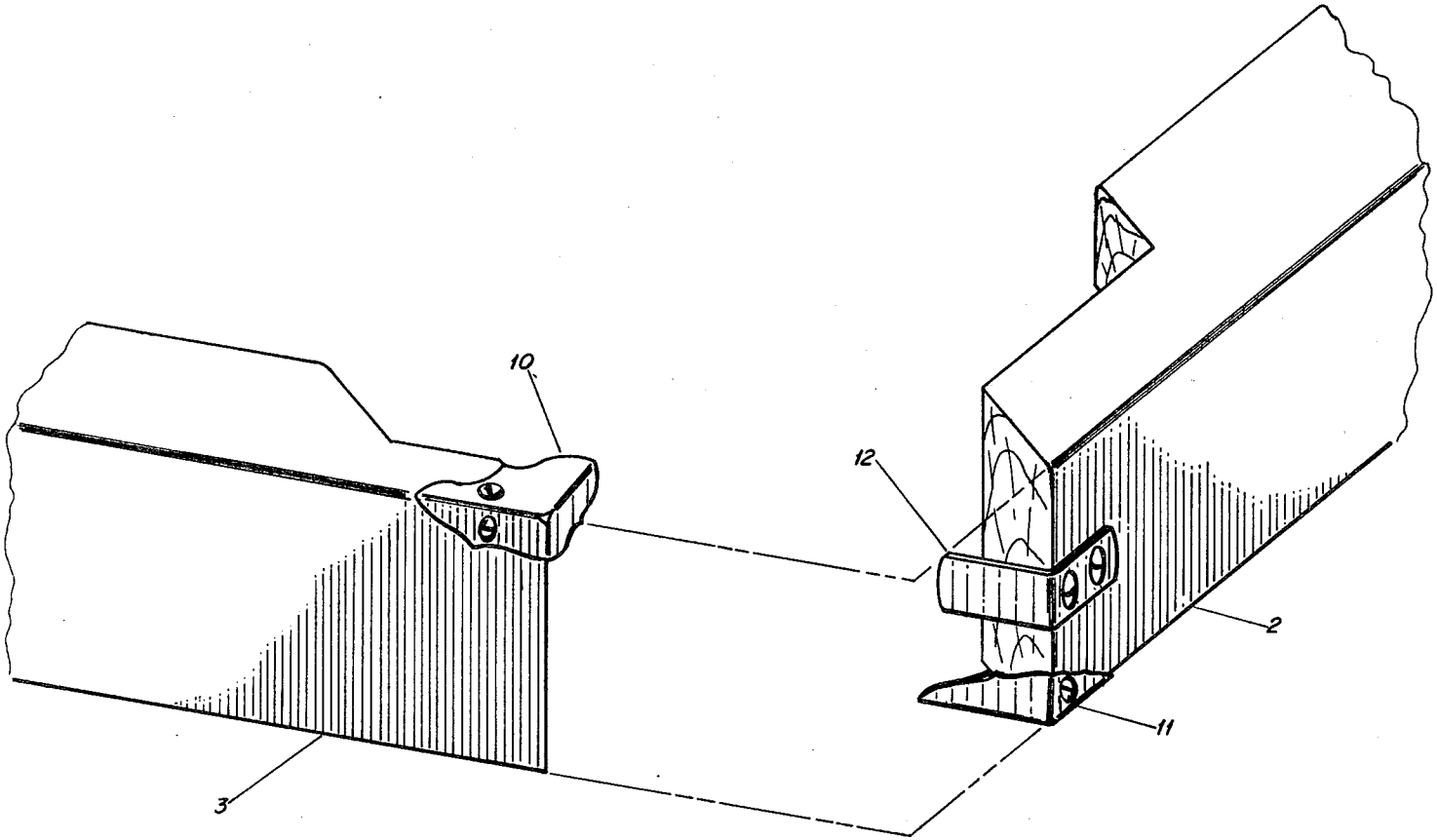
FIG. 2 is a separated view of the intersection of a side rail with an end rail.

While the frame may be constructed as a continuous undetachable unit, it preferably has disconnecting interlocking joints at the corners of the frame 6, 7, 8 and 9. These joints can be interconnected in any manner but are preferably connected as shown in FIG. 2 to maximize ease of assembly and stability of play. An upper cover plate 10 is attached to side 3 and a lower cover plate 11 is attached to side 2. An extra support attachment 12 may also be provided for additional stability. The bottom end of side 3 is then inserted into the lower cover plate 11 allowing the top end of side 2 to insert into upper cover plate 10 to interlock the ends of these sides. Each corner can be so interlocked as to provide for an easily disconnected assembly and sturdy support for game play.

As shown in FIG. 1 the longer side of the rectangular frame may consist of two sections with a hinge 13 and lock 14 to enhance the portability of the unit. The interior wall 15 of the frame is cushioned so as to provide for uniform ball rebounds during play utilizing the device. Many types of cushions may be used in a number of sizes, shapes, and design.

Figure 3:
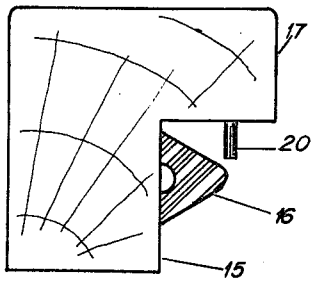
FIG. 3 is a cross-section of a frame side rail.

An illustration of a cushioned wall 15 is shown as a cross-section in FIG. 3. The cushion 16 is attached to the interior wall and is positioned around the entire frame to provide uniform playing ball rebounds. The cushion itself may be attached to the interior wall as shown in FIG. 3 or may be attached to supports which are in turn attached to the interior wall. The cushions may be of a cord-like nature, e.g., "Bungie" cord, or have any size, shape or character that will provide uniform playing ball rebounds. However, it is preferable to have a unitized rubber-like cushion 16 with a larger base than rebound surface for obtaining consistent results. A projection 17 extending over the edge of the cushion may be provided to retain balls inside the area circumferenced by the game frame. The projection should be of sufficient extension over the edge of the cushion to prevent hard hit playing balls from jumping the rail and going out of a court defined by the frame.

Figure 4:
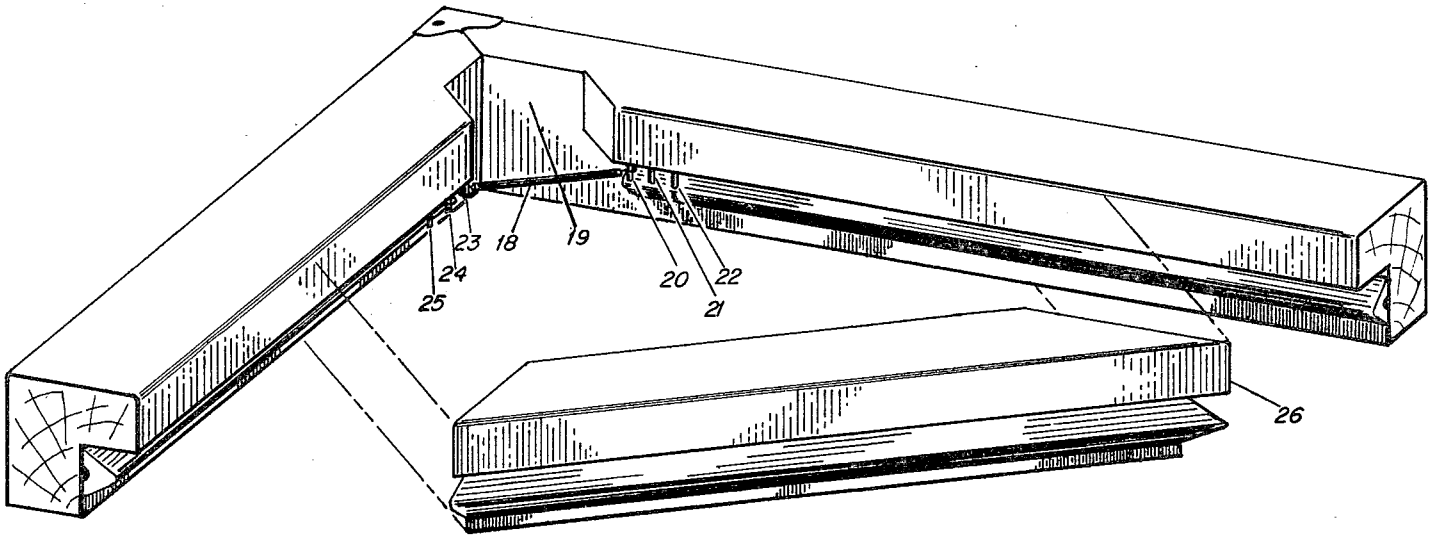
FIG. 4 is a close-up play view of a corner section of the interior side of the frame.

As further shown in FIG. 1, while the game frame may be employed with a continuous cushion on the interior walls thereof, the frame preferably has a capturing device 18 attached to its interior walls. A close up plan view of a corner section of an interior side of the frame illustrating a capturing device is shown in FIG. 4. Different types of capturing devices may be employed and may be positioned at different heights, widths and distances. The capturing device is preferably adjustable and removable and is attached in front of a corner 19 of the frame. It is also preferably of a flexible nature, e.g., a "Bungie" cord, and is situated high enough above the playing surface to allow a golf ball or other appropriate playing ball to pass under it and close enough to the playing surface to prevent a ball which has passed under the device from rolling back on to the playing surface. Several supports 20, 21, 22, 23, 24 and 25 for the capturing device may be positioned on the frame for easily adjusting the size and shape of the capturing area to alter the difficulty of the game for different ages and skills of players. In the preferred embodiment in which a frame has a projection over the cushion, the projection in a corner and preferably in all corners may be removed so as to allow for easy removal of captured playing balls from the confines of the capturing device.

In the preferred embodiment employing a capturing device on the frame a cushioned corner insert 26 may be provided as a cover to the capturing device. In this matter a contiguously cushioned interior wall is provided in which games based upon rebound phenomena and mathematical angles are played.

The device may be used for playing a variety of golf games utilizing golf balls or other similar playing balls and can be played by people of all ages with varying skills of golf putting ability. Games can be designed to feature one or a number of players in which single or multiple rebound action is utilized. The device can be constructed with a size and shape that is portable and easily storageable in an average sized storage area.

What is claimed is:

1. A golf putting frame game device played with conventional golf equipment comprising a frame suitable for use on a flat floor surface having a cushion on each interior wall thereof to provide for uniform ball rebounds during utilization of said device, a retaining projection extending over the cushion so as to retain played balls within the bounds of the frame and enhance uniformity of ball rebounds, an adjustable and removable corner capturing device, and a cushioned corner insert combined with said frame to provide a continuously cushioned interior framed wall.

* * * * *